US012280296B2

(12) United States Patent
Murphy

(10) Patent No.: US 12,280,296 B2
(45) Date of Patent: Apr. 22, 2025

(54) HAND EXERCISER AND METHOD FOR USE

(71) Applicant: Kelly Murphy, Newport, WA (US)

(72) Inventor: Mary Beth Murphy, Newport, WA (US)

( * ) Notice: Subject to any disclaimer, the term of this patent is extended or adjusted under 35 U.S.C. 154(b) by 30 days.

(21) Appl. No.: 18/117,975

(22) Filed: Mar. 6, 2023

(65) Prior Publication Data

US 2023/0277897 A1 Sep. 7, 2023

Related U.S. Application Data

(60) Provisional application No. 63/316,754, filed on Mar. 4, 2022.

(51) Int. Cl.
*A63B 23/16* (2006.01)
*A63B 21/02* (2006.01)
*A63B 21/055* (2006.01)

(52) U.S. Cl.
CPC ..... *A63B 23/16* (2013.01); *A63B 21/028* (2013.01); *A63B 21/0552* (2013.01)

(58) Field of Classification Search
CPC ..... A63B 21/00189
See application file for complete search history.

(56) References Cited

U.S. PATENT DOCUMENTS 1,623,869 A * 4/1927 Giraldi ..... A63B 21/4047 73/379.03
2,271,164 A * 1/1942 Sullivan ..... A63B 23/16 482/47
3,265,389 A * 8/1966 Carlson ..... A63B 23/16 482/49
4,730,827 A * 3/1988 Williams ..... A63B 23/16 482/92
4,828,249 A * 5/1989 Keating ..... A63B 23/16 482/121
5,342,273 A * 8/1994 Plendl ..... A63B 21/00043 482/122
5,401,225 A * 3/1995 Ko ..... A63B 21/072 482/121
D374,047 S * 9/1996 Thielemann ..... D21/682
5,681,243 A * 10/1997 Criss ..... A63B 21/028 482/49
6,179,751 B1 * 1/2001 Clears ..... A63B 21/4019 482/44
6,228,001 B1 * 5/2001 Johnson ..... A63B 21/028 482/44
D488,843 S * 4/2004 Brown ..... D21/684
6,817,967 B1 * 11/2004 Ott ..... A63B 21/4019 482/47
7,037,240 B2 * 5/2006 Pemberton ..... A63B 23/16 482/121

(Continued)

FOREIGN PATENT DOCUMENTS

DE 202023103409 U1 * 10/2023

*Primary Examiner* — Nyca T Nguyen
(74) *Attorney, Agent, or Firm* — Randall Danskin P.S.

(57) ABSTRACT

A hand exerciser to strengthen and promote flexibility for both extension and flexion for the fingers, thumb and hand has a body defined by a resiliently deformable first outer ring and a resiliently deformable second inner ring that is concentric with the first outer ring. Flexion exercises utilize the first outer ring while extension exercises utilize the second inner ring.

12 Claims, 6 Drawing Sheets

(56) References Cited

U.S. PATENT DOCUMENTS

| | | | | |
|---|---|---|---|---|
| 7,381,156 | B2 * | 6/2008 | Silagy | A63B 21/0004 482/44 |
| D583,884 | S * | 12/2008 | Zickert | D21/684 |
| D715,449 | S * | 10/2014 | Wang | D24/188 |
| D725,726 | S * | 3/2015 | Gomez | D21/684 |
| D858,661 | S * | 9/2019 | Wang | D21/684 |
| 10,449,404 | B2 * | 10/2019 | Wood | A63B 23/0205 |
| 10,918,898 | B1 * | 2/2021 | Palacios | A63B 21/0603 |
| 2003/0069109 | A1 * | 4/2003 | Bender | A63B 21/028 482/44 |
| 2003/0139257 | A1 * | 7/2003 | Pemberton | A63B 23/16 482/44 |
| 2007/0129216 | A1 * | 6/2007 | Ott | A63B 21/0004 482/47 |
| 2008/0090486 | A1 * | 4/2008 | Zawitz | A63H 33/18 446/124 |
| 2008/0300112 | A1 * | 12/2008 | Crout | A63B 21/0552 482/48 |
| 2009/0029830 | A1 * | 1/2009 | Chiang | A63B 23/16 482/44 |
| 2009/0093352 | A1 * | 4/2009 | Krupa | A63B 21/026 482/92 |
| 2009/0318269 | A1 * | 12/2009 | D'Addario | A63B 21/023 482/49 |
| 2011/0136633 | A1 * | 6/2011 | Riggs | A63B 23/0211 482/121 |
| 2013/0331233 | A1 * | 12/2013 | Wilson | A63B 21/4035 482/46 |
| 2018/0214742 | A1 * | 8/2018 | Harrison | A63B 21/4017 |
| 2019/0209883 | A1 * | 7/2019 | Endemann | A63B 21/026 |

* cited by examiner

HAND EXERCISER AND METHOD FOR USE

RELATED APPLICATIONS AND PRIORITY

This US Non-Provisional Utility patent application claims the benefit of priority to earlier filed U.S. Provisional Patent Application No. 63/316,754 filed on Mar. 4, 2022 and titled "The Finger Yogi is an exercise device designed to strengthen and promote flexibility for both extension and flexion for the fingers, thumb and hand."

The entire contents of the identified earlier filed U.S. Provisional Patent Application No. 63/316,754 is expressly and completely incorporated herein by this reference.

Pursuant to USPTO rules, this claim of priority is also set forth in the Application Data Sheet (ADS) filed contemporaneously with this US Non-Provisional Utility patent application.

TECHNICAL FIELD

A hand exerciser to strengthen both extension and flexion of a user's fingers, thumb and hand and a method for using the same.

BACKGROUND OF THE INVENTION

Hand exercises have an object of improving mobility, range of motion, flexibility and the strengthening of the hand, thumb and fingers in addition to improving coordination and endurance. Hand exercises may include flexion exercises wherein the fingers and thumb are flexed inwardly to grip onto an item. Hand exercises may also include extension exercises wherein the fingers and thumb are extended outwardly away from the palm of the hand.

My invention is a device that can be used to rehabilitate/promote healing the fingers/thumb/hand as well as flexibility and improving/increasing range of motion and strength.

My invention may further be used after an injury, or post-surgery, to strengthen the muscles and connective tissues of the fingers/hand while promoting better coordination. Use of my invention enhances both major and fine motor skills of the fingers and thumb of the hands. My invention has an outer ring and an inner ring that can be used by both the right and left fingers/thumb/hand. My invention can be manufactured in various different sizes so as to be used effectively by children as well as adults.

My invention is multidimensional, portable, easy to use, easy to clean, intuitive and is ergonomically correct.

SUMMARY OF THE INVENTION

The disclosed hand exerciser generally comprises a first outer ring (20), and a second inner ring (40) that is generally concentric within the first outer ring (20). Both the first outer ring (20) and the second inner ring (40) are formed of a material that is resiliently deformable and that has retentive memory.

A principal aspect of the present invention is a hand exerciser (9) comprising a body (10) having a first ring (20) and a second ring (40); the first ring (20) is generally annular in configuration and defines a first medial space (22), a first major diameter (25), a first minor diameter (28), an outer circumferentially extending surface (29) and an inner circumferentially extending surface (30), and the outer circumferentially extending surface (29) has plural spacedly arrayed finger flexion saddles (31), and at a generally diametrically opposed position, the outer circumferentially extending surface (29) has a thumb flexion saddle (32); and the second ring (40) is generally oblong in configuration and defines a second medial space (42), a second major diameter (45), a second minor diameter (48), an outer circumferentially extending surface (49) and an inner circumferentially extending surface (50), and wherein the inner circumferentially extending surface (50) has plural spacedly arrayed finger extension saddles (51), and at a generally diametrically opposed position, the inner circumferentially extending surface (50) has a thumb extension saddle (52); and the first ring (20) and the second ring (40) are generally concentric, and are interconnected to one another along the respective major diameters 25, 45.

A further aspect of the present invention is a hand exerciser (9) wherein the body (10) is formed of a resiliently deformable material, and the resiliently deformable material has a degree of retentive memory so that the body (10) tends to return to an original configuration (60) after being distorted from the original configuration (60).

A further aspect of the present invention is a hand exerciser (9) wherein the resiliently deformable material is a polymer.

A further aspect of the present invention is a hand exerciser (9) wherein the resiliently deformable material is rubber.

A further aspect of the present invention is a hand exerciser (9) wherein the resiliently deformable material is elastomeric.

A further aspect of the present invention is a hand exerciser (9) wherein the first ring (20) has an elongated annular configuration (21); and the second ring (40) has an elongated annular configuration.

A further aspect of the present invention is a hand exerciser (9) wherein the first ring (20) has a first end (23), a diametrically opposed second end (24) and a first major diameter (25) is defined therebetween; and a first side (26) and a diametrically opposed second side (27) and a first minor diameter (28) is defined therebetween.

A further aspect of the present invention is a hand exerciser (9) wherein the second ring (40) has a first end (43), a diametrically opposed second end (44) and a second major diameter (45) is defined therebetween; and a first side (46) and a diametrically opposed second side (47) and a second minor diameter (48) is defined therebetween.

A further aspect of the present invention is a hand exerciser (9) wherein the second ring (40) is carried within a first medial space (22) defined by the first ring (20), and first ring (20) and the second ring (40) are interconnected to one another at the respective first end portions (23, 43) and the second end portions (24, 44) so that the first major diameter (25) of the first ring (20) and the second major diameter (45) of the second ring (40) are coaxially aligned; and the second minor diameter (48) of the second ring (40) is smaller than the first minor diameter (28) of the first ring (20).

A further aspect of the present invention is a hand exerciser (9) comprising a body (10) formed of a resiliently deformable material, the resiliently deformable material having at least a degree of retentive memory so that the body (10) tends to return to an original configuration (60) after being distorted from the original configuration (60), the body (10) defined by a first ring (20) and a second ring (40); the first ring (20) has an elongated annular configuration (21) defining a first medial space (22), and the first ring (20) has a first end (23) and a diametrically opposed second end (24) defining a first major diameter (25) therebetween, a first side (26) and a diametrically opposed second side (27)

defining a first minor diameter (28) therebetween, an outer circumferentially extending surface (29) and an inner circumferentially extending surface (30), and wherein the outer circumferentially extending surface (29), and on the second side (27), has plural spacedly arrayed finger flexion saddles (31), and the outer circumferentially extending surface (29), and on the first side (26) has a thumb flexion saddle (32); and the second ring (40) is generally concentric with the first ring (20) and the second ring (40) has an elongated annular configuration (41) defining a second medial space (42), and the second ring (40) has a first end (43) and a diametrically opposed second end (44) defining a second major diameter (45) therebetween, a first side (46) and a diametrically opposed second side (47) defining a second minor diameter (48) therebetween, and an outer circumferentially extending surface (49) and an inner circumferentially extending surface (50), and wherein the inner circumferentially extending surface (50), and on the second side (47), has plural spacedly arrayed finger extension saddles (51), and the inner circumferentially extending surface (50), and on the first side (46), has a thumb extension saddle (52); and wherein the second ring (40) is carried within the first medial space (22) defined by the first ring (20) and first ring (20) and the second ring (40) are interconnected to one another at the first end portions (23, 43) and at the diametrically opposed second end portions (24, 44) so that the first major diameter (25) of the first ring (20) and the second major diameter (45) of the second ring (40) are coaxially aligned; and the second minor diameter (48) of the second ring (40) is smaller than the first minor diameter (28) of the first ring (20).

A still further aspect of the present invention is a method for using a hand exerciser (9) comprising the steps: providing a hand exerciser (9) that has a body (10) formed of a resiliently deformable material that has a degree of retentive memory so that the body (10) tends to return to an original configuration (60) after being distorted from the original configuration (60), the body (10) defined by a first ring (20) and a second ring (40), the first ring (20) having an elongated annular configuration (21) defining a first medial space (22), and the first ring (20) has a first end (23) and a diametrically opposed second end (24) defining a first major diameter (25) therebetween, a first side (26) and a diametrically opposed second side (27) defining a first minor diameter (28) therebetween, an outer circumferentially extending surface (29) and an inner circumferentially extending surface (30), and wherein the outer circumferentially extending surface (29), and on the second side (27), has plural spacedly arrayed finger flexion saddles (31), and the outer circumferentially extending surface (29), and on the first side (26), has a thumb flexion saddle (32), and the second ring (40) is generally concentric within the first ring (20) and the second ring (40) has an elongated annular configuration (41) defining a second medial space (42), and the second ring (40) has a first end (43) and a diametrically opposed second end (44) defining a second major diameter (45) therebetween, a first side (46) and a diametrically opposed second side (47) defining a second minor diameter (48) therebetween, and an outer circumferentially extending surface (49) and an Inner circumferentially extending surface (50), and wherein the Inner circumferentially extending surface (50), and on the second side (47), has plural spacedly arrayed finger extension saddles (51), and the inner circumferentially extending surface (50), and on the first side (46) has a thumb extension saddle (52), and wherein the second ring (40) is carried within the first medial space (22) defined by the first ring (20), and first ring (20) and the second ring (40) are interconnected to one at the first end portions (23, 43) and at the diametrically opposed second end portions (24, 44) so that the first major diameter (25) of the first ring (20) and the second major diameter (45) of the second ring (40) are coaxially aligned, and the second minor diameter (48) of the second ring (40) is smaller than the first minor diameter (28) of the first ring (20); grasping the body (10) about the outer circumferentially extending surface (29) of the first ring (20) and placing a finger of a user's hand within each of the plural spacedly arrayed finger flexion saddles (31) of the first ring (20), and placing the user's thumb within the thumb flexion saddle (32) defined in the first ring (20) generally diametrically opposite the plural finger flexion saddles (31); and repeatedly flexing and relaxing the fingers and thumb of the user to squeeze the first ring (20) and responsively distort the original configuration (60) of the first ring (20) and the body (10) generally along the first minor diameter (28), and then relaxing the fingers and the thumb to allow the first ring (20) and the body (10) to return to its original configuration (60), and then repeating the flexing and distorting.

An even still further aspect of the present invention is a method for using a hand exerciser (9) wherein the user's fingers and thumb are placed within the second medial space (42) defined by the second ring (40), and the user's fingers are positioned within the plural spacedly arrayed finger extension saddles (51) of the inner circumferentially extending surface (50) of the second ring (40); and the user's thumb is placed within the thumb extension saddle (52) of the inner circumferentially extending surface (50) of the second ring (40) generally diametrically opposite the plural spacedly arrayed finger extension saddles (51) and along the second minor diameter (48) of the second ring (40); and repeatedly extending and relaxing the fingers and thumb to responsively distort the original configuration (60) of the second ring (40) generally along the second minor diameter (28) and then allowing the second ring (40) to return to its original configuration (60) and then repeating the extension and distorting.

These and other aspects of my hand exerciser and method for use are disclosed herein

BRIEF DESCRIPTIONS OF THE DRAWINGS

DETAILED DESCRIPTION OF THE PREFERRED EMBODIMENTS

This disclosure of the invention is submitted in furtherance of the Constitutional purposes of the U.S. Patent Laws "to promote the progress of science and useful arts" (Article 1, Section 8).

Figure 1:
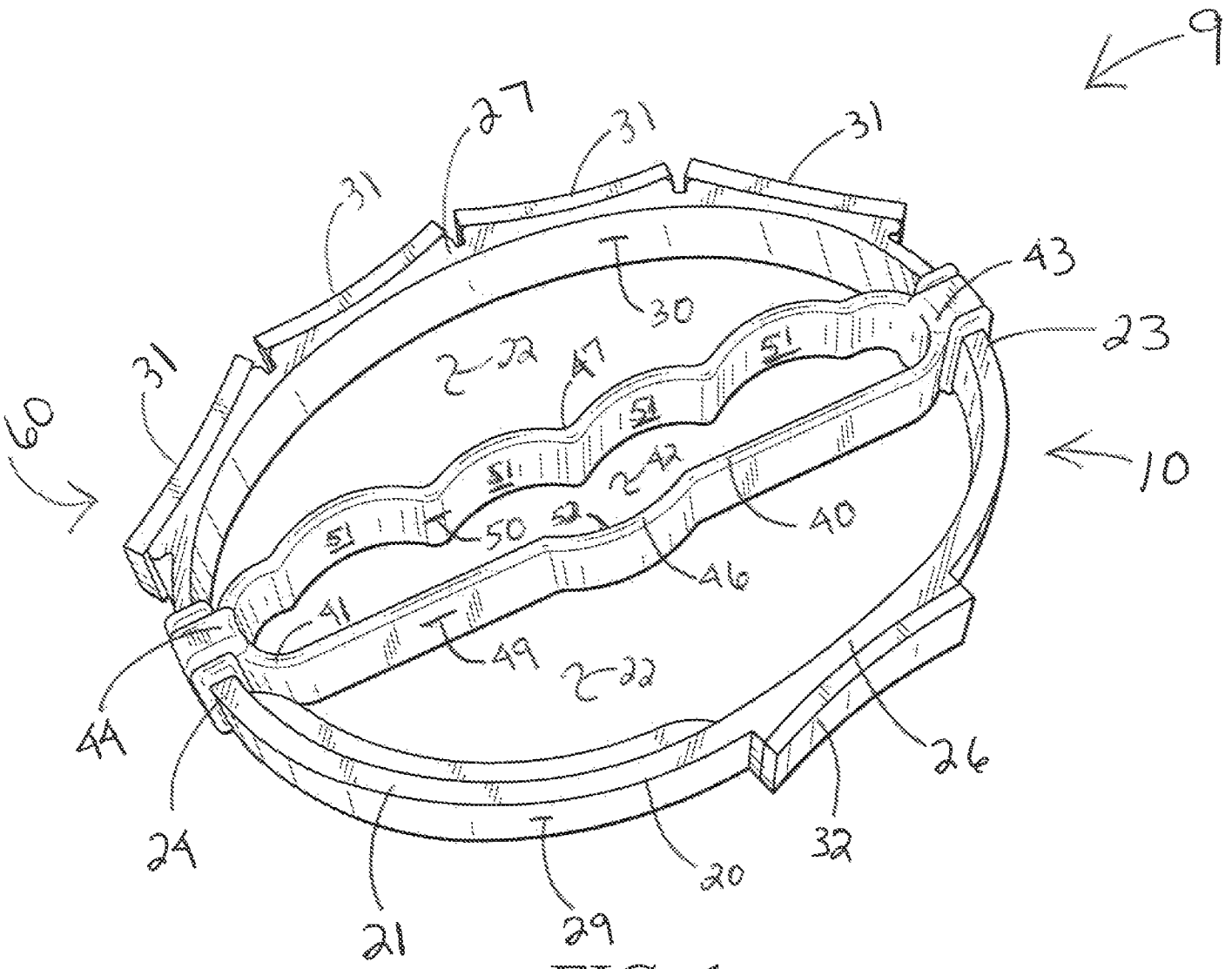
FIG. 1 is a perspective view of my hand exerciser showing the position and the orientation of the various components relative to one another.
Figure 2:
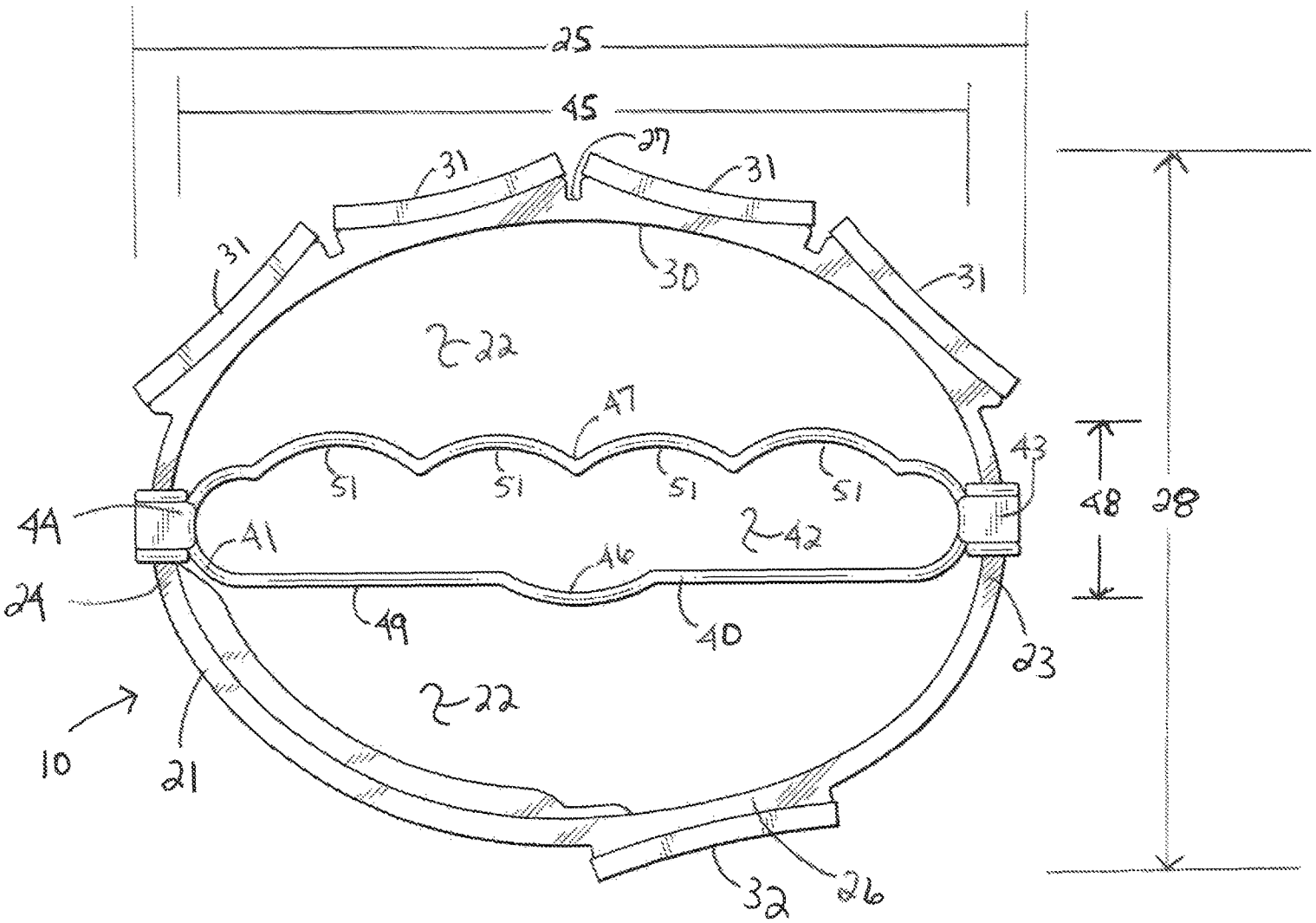
FIG. 2 is an orthographic side view of the hand exerciser.
Figure 3:
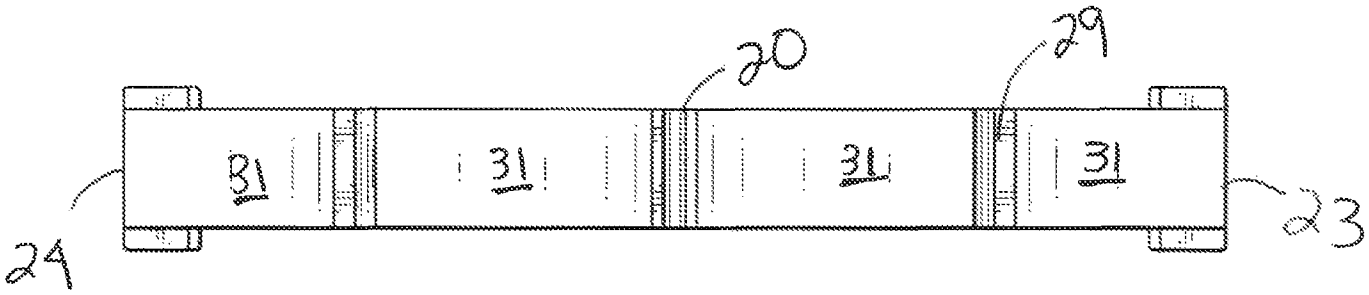
FIG. 3 is an orthographic finger saddle side view of the hand exerciser.
Figure 4:
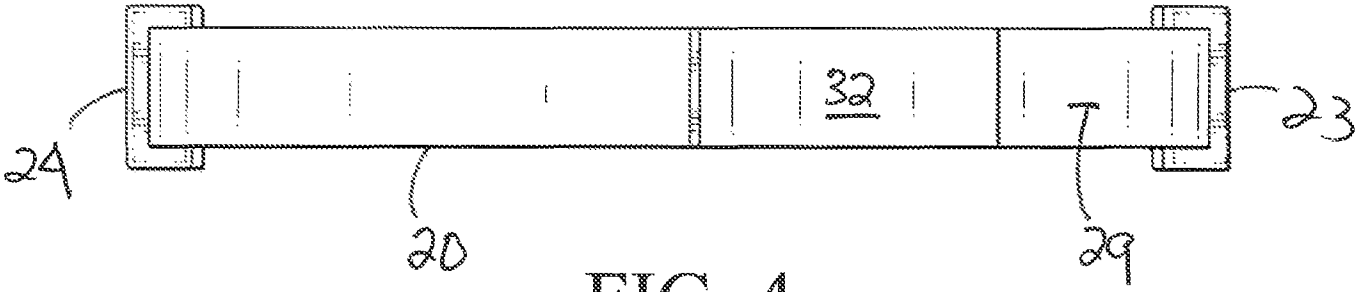
FIG. 4 is an orthographic thumb saddle side view of the hand exerciser.
Figure 6:
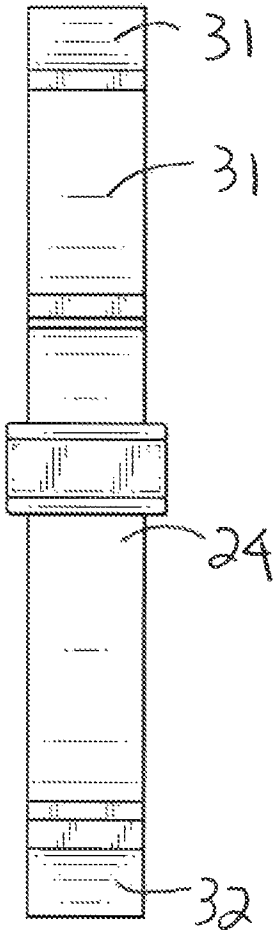
FIG. 6 is an orthographic second end view of the hand exerciser.
Figure 5:
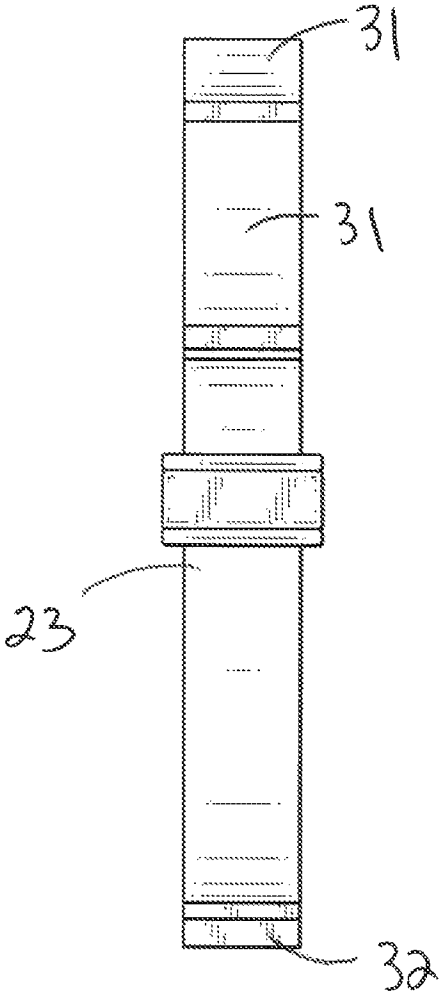
FIG. 5 is an orthographic first end view of the hand exerciser.

As shown in FIG. 1, my hand exerciser (9) generally comprises a body (10) that is formed of a resiliently deformable material, that has at least some degree of retentive memory so that the body (10) tends to return to an original configuration (60) after being distorted from the original configuration (60) such as by a user exerting flexion forces (FIG. 7) on the body (10) and or extension forces (FIG. 8) on the body (10). In one contemplated embodiment, the body (10) is formed of an elastomeric polymer, but other materials including, but not limited to, rubber, plastic, polymers may likewise be used, and are contemplated herein.

The body (10) is defined by a first ring (20) and a second ring (40). The second ring (40) is generally concentric with the first ring (20).

The first ring (20) has an elongated annular configuration (21) defining a first medial space (22). The first ring (20) further has a first end (23) and diametrically opposed second end (24) and defines a first major diameter (25) therebetween. The first ring (20) further has a first side (26) and a diametrically opposed second side (27) and a defines a first minor diameter (28) therebetween. The first ring (20) still further has an outer circumferentially extending surface (29) and an inner circumferentially extending surface (30).

Plural spacedly arrayed finger flexion saddles (31) are spacedly arrayed on the outer circumferentially extending surface (29), and on the second side (27). The plural spacedly arrayed finger flexion saddles (31) are contemplated to be integral with the outer circumferentially extending surface (29), but it is also contemplated the plural spacedly arrayed finger flexion saddles (31) may also be separately formed, and thereafter attached to the outer circumferentially extending surface (29). It is still further contemplated the plural spacedly arrayed finger saddles (31) may be defined in the outer circumferentially extending surface (29).

A thumb flexion saddle (32) is on the outer circumferentially extending surface (29), and on the first side (26) generally diametrically opposite the plural spacedly arrayed finger flexion saddles (31). Similarly, the thumb flexion saddle (32) is contemplated to be integral with the outer circumferentially extending surface (29), but it is also contemplated the thumb flexion saddle (32) may also be separately formed, and thereafter attached to the outer circumferentially extending surface (29), and, or defined in the outer circumferentially extending surface (29).

The second ring (40) has an elongated annular configuration (41) and defines a second medial space (42). The second ring (40) further has a first end (43) and diametrically opposed second end (44) and defines a second major diameter (45) therebetween. The second ring (40) still further has a first side (46) and a diametrically opposed second side (47) and defines a second minor diameter (48) therebetween. The second ring (40) even still further has an outer circumferentially extending surface (49) and an inner circumferentially extending surface (50).

As shown in the Figures, the inner circumferentially extending surface (50) of the second ring (40), and on the second side (47) thereof, has plural spacedly arrayed finger extension saddles (51). Further, the inner circumferentially extending surface (50), and on the first side (46) thereof, has a thumb extension saddle (52). Similar to the flexion saddles (31, 32) the extension saddles (51, 52) are contemplated to be integral with the inner circumferentially extending surface (50), but it is also contemplated the extension saddles (51, 52) may also be separately formed, and thereafter attached to the inner circumferentially extending surface (50), and, or even defined within the inner circumferentially extending surface (50).

The second ring (40) is carried within the first medial space (22) defined by the first ring (20) and first ring (20) and the second ring (40) are interconnected to one another at the respective first end portions (23, 43) and at the diametrically opposed respective second end portions (24, 44) so that the first major diameter (25) of the first ring (20) and the second major diameter (45) of the second ring (40) are coaxially aligned. As shown in the drawings, the second minor diameter (48) of the second ring (40) is smaller than the first minor diameter (28) of the first ring (20).

Figure 7:
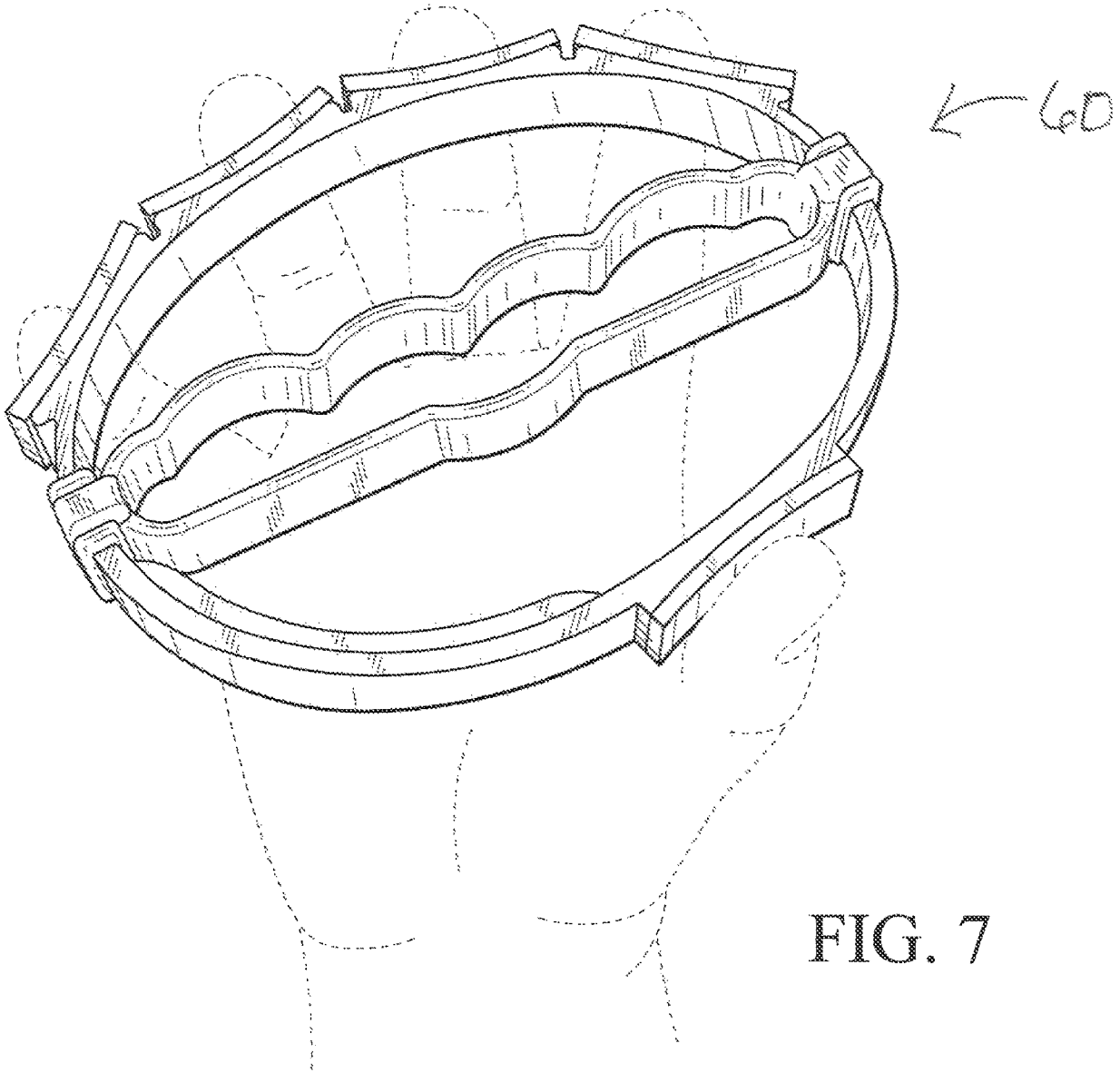
FIG. 7 is a perspective view of the hand exerciser, similar to FIG. 1 showing, in dashed outline, a user's fingers and thumb grasping the finger saddles and a thumb saddle of the first ring for flexion exercises, the hand exerciser in the original configuration.

As shown in FIG. 7, flexion forces exerted upon the first ring (20), by the user, cause the first side (26) and the second side (27) of the first ring (20) to move inwardly toward one another generally along the first minor diameter (28). The retentive memory of the material forming the first ring (20) generally causes the first ring (20) to return to its original configuration (60) when the flexion forces exerted thereon are released.

Figure 8:
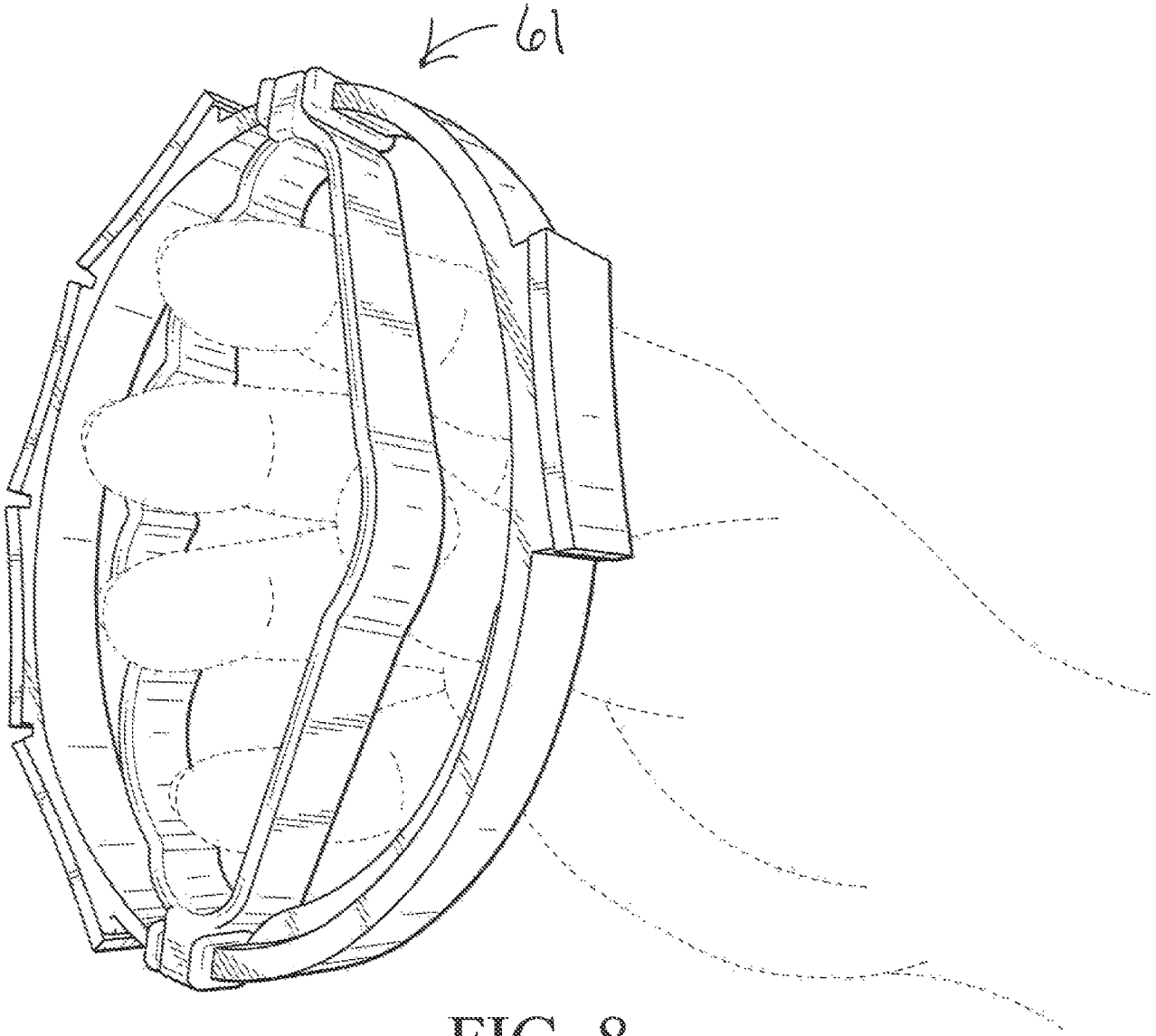
FIG. 8 is a perspective view of the hand exerciser showing, in dashed outline, a user's fingers and thumbs engaged with the finger saddles and thumb saddle of the second ring for extension exercises, the hand exerciser in a distorted configuration.

As shown in FIG. 8, extension forces exerted upon the second ring (40), by the user, cause the first side (46) and the second side (47) of the second ring (40) to move distally away from one another generally along the second minor diameter (48). The retentive memory of the material forming the second ring (40) generally causes the second ring (40) to return to its original configuration (60) when the extension forces exerted thereon are released.

Operation

Having described the structure of my hand exerciser (9), its operation is briefly described.

A principal object of my invention is a method for using a hand exerciser (9) comprising the steps: providing a hand exerciser (9) that has a body (10) formed of a resiliently deformable material that has a degree of retentive memory so that the body (10) tends to return to an original configuration (60) after being distorted from the original configuration (60), the body (10) defined by a first ring (20) and a second ring (40), the first ring (20) having an elongated annular configuration (21) defining a first medial space (22), and the first ring (20) has a first end (23) and a diametrically opposed second end (24) defining a first major diameter (25) therebetween, a first side (26) and a diametrically opposed second side (27) defining a first minor diameter (28) therebetween, and an outer circumferentially extending surface (29) and an inner circumferentially extending surface (30), and wherein the outer circumferentially extending surface (29), and on the second side (27), has plural spacedly arrayed finger flexion saddles (31), and the outer circumferentially extending surface (29), and on the first side (26), has a thumb flexion saddle (32), and the second ring (40) is generally concentric with the first ring (20) and the second ring (40) has an elongated annular configuration (41) defining a second medial space (42), and the second ring (40) has a first end (43) and a diametrically opposed second end (44) defining a second major diameter (45) therebetween, a first side (46) and a diametrically opposed second side (47) defining a second minor diameter (48) therebetween, and an outer circumferentially extending surface (49) and an inner circumferentially extending surface (50), and wherein the inner circumferentially extending surface (50), and on the second side (47), has plural spacedly arrayed finger extension saddles (51), and the inner circumferentially extending surface (50), and on the first side (46) has a thumb extension saddle (52), and wherein the second ring (40) is carried within the first medial space (22) defined by the first ring (20), and first ring (20) and the second ring (40) are interconnected to one at the first end portions (23, 43) and at the diametrically opposed second end portions (24, 44) so that the first major diameter (25) of the first ring (20) and the second major diameter (45) of the second ring (40) are coaxially aligned, and the second minor diameter (48) of the second ring (40) is smaller than the first minor diameter (28) of the first ring (20); grasping the body (10) about the outer circumferentially extending surface (29) of the first ring (20) and placing a finger of a user's hand within each of the plural spacedly arrayed finger flexion saddles (31) of the first ring (20), and placing the user's thumb within the thumb flexion saddle (32) defined in the first ring (20) generally diametrically opposite the plural finger flexion saddles (31); and repeatedly flexing and relaxing the fingers and thumb of the user to squeeze the first ring (20) and the body (10) and responsively distort the original configuration (60) of the first ring (20) and the body (10) generally along the first minor diameter (28), and then relaxing the fingers and the thumb to allow the first ring (20) and the body (10) to return to its original configuration (60), and then repeating the flexing and distorting.

A further object of the present invention is a hand exerciser (9) comprising: a body (10) having a first ring (20) and a second ring (40), and the first ring (20) and the second ring (40); the first ring (20) is generally annular in configuration and defines a first medial space (22), a first major diameter (25), a first minor diameter (28), and an outer circumferentially extending surface (29) and an inner circumferentially extending surface (30), and the outer circumferentially extending surface (29) has plural spacedly arrayed finger flexion saddles (31), and at a generally diametrically opposed position, the outer circumferentially extending surface (29) has a thumb flexion saddle (32); and the second ring (40) is generally oblong in configuration and defines a second medial space (42), a second major diameter (45), a second minor diameter (48), an outer circumferentially extending surface (49) and an inner circumferentially extending surface (50), and wherein the inner circumferentially extending surface (50) has plural spacedly arrayed finger extension saddles (51), and at a generally diametrically opposed position, the inner circumferentially extending surface (50) has a thumb extension saddle (52); and the first ring (20) and the second ring (40) are generally concentric, and are interconnected to one another along the respective major diameters 25, 45.

A further object of the present invention is a hand exerciser (9) wherein body (10) is formed of a resiliently deformable material, and the resiliently deformable material has a degree of retentive memory so that the body (10) tends to return to an original configuration (60) after being distorted from the original configuration (60).

A further object of the present invention is a hand exerciser (9) wherein the resiliently deformable material is a polymer.

A further object of the present invention is a hand exerciser (9) wherein the resiliently deformable material is rubber.

A further object of the present invention is a hand exerciser (9) wherein the resiliently deformable material is elastomeric.

A further object of the present invention is a hand exerciser (9) wherein the first ring (20) has an elongated annular configuration (21); and the second ring (40) has an elongated annular configuration.

A further object of the present invention is a hand exerciser (9) wherein the first ring (20) has a first end (23), a diametrically opposed second end (24) and the first major diameter (25) is defined therebetween; and a first side (26) and a diametrically opposed second side (27) and the first minor diameter (28) is defined therebetween.

A further object of the present invention is a hand exerciser (9) wherein the second ring (40) has a first end (43), a diametrically opposed second end (44) and the second major diameter (45) is defined therebetween; and a first side (46) and a diametrically opposed second side (47) and the second minor diameter (48) is defined therebetween.

A further object of the present invention is a hand exerciser (9) wherein the second ring (40) is carried within the first medial space (22) defined by the first ring (20), and first ring (20) and the second ring (40) are interconnected to one at diametrically opposed first end portions (23, 43) and second end portions (24, 44) so that the first major diameter (25) of the first ring (20) and the second major diameter (45) of the second ring (40) are coaxially aligned; and the second minor diameter (48) of the second ring (40) is smaller than the first minor diameter (28) of the first ring (20).

A further object of the present invention is a hand exerciser (9) comprising: a body (10) formed of a resiliently deformable material, the resiliently deformable material having at least a degree of retentive memory so that the body (10) tends to return to an original configuration (60) after being distorted from the original configuration (60), the body (10) defined by a first ring (20) and a second ring (40); the first ring (20) has an elongated annular configuration (21) defining a first medial space (22), and the first ring (20) has a first end (23) and diametrically opposed second end (24) defining a first major diameter (25) therebetween, a first side (26) and a diametrically opposed second side (27) defining a first minor diameter (28) therebetween, and an outer circumferentially extending surface (29) and an inner circumferentially extending surface (30), and wherein the outer circumferentially extending surface (29), and on the second side (27), has plural spacedly arrayed finger flexion saddles (31), and the outer circumferentially extending surface (29), and on the first side (26) has a thumb flexion saddle (32); and the second ring (40) is generally concentric within the first ring (20) and the second ring (40) has an elongated annular configuration (41) defining a second medial space (42), and the second ring (40) has a first end (43) and diametrically opposed second end (44) defining a second major diameter (45) therebetween, a first side (46) and a diametrically opposed second side (47) defining a second minor diameter (48) therebetween, and an outer circumferentially extending surface (49) and an inner circumferentially extending surface (50), and wherein the inner circumferentially extending surface (50), and on the second side (47), has plural spacedly arrayed finger extension saddles (51), and the inner circumferentially extending surface (50), and on the first side (46), has a thumb extension saddle (52); and wherein the second ring (40) is carried within the first medial space (22) defined by the first ring (20) and first ring (20) and the second ring (40) are interconnected to one another at the first end portions (23, 43) and at the diametrically opposed second end portions (24, 44) so that the first major diameter (25) of the first ring (20) and the second major diameter (45) of the second ring (40) are coaxially aligned; and the second minor diameter (48) of the second ring (40) is smaller than the first minor diameter (28) of the first ring (20).

An even still further object of the present invention is a method for using a hand exerciser (9) wherein the user's fingers and thumb are placed within the second medial space (42) defined by the second ring (40), and the user's fingers are positioned within the plural spacedly arrayed finger extension saddles (51) of the inner circumferentially extending surface (50) of the second ring (40); and the user's thumb is placed within the thumb extension saddle (52) of the inner circumferentially extending surface (50) of the second ring (40) generally diametrically opposite the plural spacedly arrayed finger extension saddles (51) and along the second minor diameter (48) of the second ring (40); and repeatedly extending and relaxing the fingers and thumb to responsively distort the original configuration (60) of the second ring (40) generally along the second minor diameter (48) and then allowing the second ring (40) to return to its original configuration (60) and then repeating the extension and distorting.

I claim:

1. A hand exerciser comprising:

a body having a first ring, and a second ring; and the first ring is generally annular in configuration and defines a first medial space, a first major diameter, a first minor diameter, and an outer circumferentially extending surface and an inner circumferentially extending surface, and the outer circumferentially extending surface has plural spacedly arrayed finger flexion saddles, and at a generally diametrically opposed position, the outer circumferentially extending surface has a thumb flexion saddle; and the second ring is generally oblong in configuration and defines a second medial space, a second major diameter, a second minor diameter, an outer circumferentially extending surface and an inner circumferentially extending surface, and wherein the inner circumferentially extending surface has plural spacedly arrayed finger extension saddles, and at a generally diametrically opposed position, the inner circumferentially extending surface has a thumb extension saddle; and the first ring and the second ring are generally concentric, and are interconnected to one another along the respective major diameters.

2. The hand exerciser as claimed in claim 1 and wherein the body is formed of a resiliently deformable material, and the resiliently deformable material has a degree of retentive memory so that the body is adapted to return to an original configuration after being distorted from the original configuration.

3. The hand exerciser as claimed in claim 2 and wherein the resiliently deformable material is a polymer.

4. The hand exerciser as claimed in claim 2 and wherein the resiliently deformable material is rubber.

5. The hand exerciser as claimed in claim 2 and wherein the resiliently deformable material is elastomeric.

6. The hand exerciser as claimed in claim 1 and wherein the first ring has an elongated annular configuration; and the second ring has an elongated annular configuration.

7. The hand exerciser as claimed in claim 1 and wherein the first ring has a first end, a diametrically opposed second end and the first major diameter is defined therebetween; and a first side and a diametrically opposed second side and the first minor diameter is defined therebetween.

8. The hand exerciser as claimed in claim 1 and wherein the second ring has a first end, a diametrically opposed second end and the second major diameter is defined therebetween; and a first side and a diametrically opposed second side and the second minor diameter is defined therebetween.

9. The hand exerciser as claimed in claim 1 and wherein the second ring is carried within the first medial space defined by the first ring, and the first ring and the second ring are interconnected to one another at diametrically opposed first ends and second ends so that the first major diameter of the first ring and the second major diameter of the second ring are coaxially aligned; and the second minor diameter of the second ring is smaller than the first minor diameter of the first ring.

10. A hand exerciser comprising:

a body formed of a resiliently deformable material, the resiliently deformable material having at least a degree of retentive memory so that the body is adapted to return to an original configuration after being distorted from the original configuration, the body defined by a first ring and a second ring;

the first ring has an elongated annular configuration defining a first medial space, and the first ring has a first end and diametrically opposed second end defining a first major diameter therebetween, a first side and a diametrically opposed second side defining a first minor diameter therebetween, and an outer circumferentially extending surface and an inner circumferentially extending surface, and wherein the outer circumferentially extending surface, and on the second side, has plural spacedly arrayed finger flexion saddles, and the outer circumferentially extending surface, and on the first side has a thumb flexion saddle; and the second ring is generally concentric within the first ring and the second ring has an elongated annular configuration defining a second medial space, and the second ring has a first end and diametrically opposed second end defining a second major diameter therebetween, a first side and a diametrically opposed second side defining a second minor diameter therebetween, and an outer circumferentially extending surface and an inner circumferentially extending surface, and wherein the inner circumferentially extending surface, and on the second side, has plural spacedly arrayed finger extension saddles, and the inner circumferentially extending surface, and on the first side, has a thumb extension saddle; and wherein the second ring is carried within the first medial space defined by the first ring and the first ring and the second ring are interconnected to one another at the first ends and at the diametrically opposed second ends so that the first major diameter of the first ring and the second major diameter of the second ring are coaxially aligned; and the second minor diameter of the second ring is smaller than the first minor diameter of the first ring.

11. A method for using a hand exerciser comprising the steps:

providing a hand exerciser that has a body formed of a resiliently deformable material that has a degree of retentive memory so that the body is adapted to return to an original configuration after being distorted from the original configuration, the body defined by a first ring and a second ring, the first ring having an elongated annular configuration defining a first medial space, and the first ring has a first end and a diametrically opposed second end defining a first major diameter therebetween, a first side and a diametrically opposed second side defining a first minor diameter therebetween, and an outer circumferentially extending surface and an inner circumferentially extending surface, and wherein the outer circumferentially extending surface, and on the second side, has plural spacedly arrayed finger flexion saddles, and the outer circumferentially extending surface, and on the first side, has a thumb flexion saddle, and the second ring is generally concentric within the first ring and the second ring has an elongated annular configuration defining a second medial space, and the second ring has a first end and a diametrically opposed second end defining a second major diameter therebetween, a first side and a diametrically opposed second side defining a second minor diameter therebetween, and an outer circumferentially extending surface and an inner circumferentially extending surface, and wherein the inner circumferentially extending surface, and on the second side, has plural spacedly arrayed finger extension saddles, and the inner circumferentially extending surface, and on the first side has a thumb extension saddle, and wherein the second ring is carried within the first medial space defined by the first ring, and the first ring and the second ring are interconnected to one another at the first ends and at the diametrically opposed second ends so that the first major diameter of the first ring and the second major diameter of the second ring are coaxially aligned, and the second minor diameter of the second ring is smaller than the first minor diameter of the first ring;

grasping the body about the outer circumferentially extending surface of the first ring and placing a finger of a user's hand within each of the plural spacedly arrayed finger flexion saddles of the first ring, and placing the user's thumb within the thumb flexion saddle defined in the first ring generally diametrically opposite the plural finger flexion saddles; and repeatedly flexing and relaxing the fingers and thumb of the user to squeeze the first ring and the body and responsively distort the original configuration of the first ring and the body generally along the first minor diameter, and then relaxing the fingers and the thumb to allow the first ring and the body to return to its original configuration, and then repeating the flexing and distorting.

12. The method of using a hand exerciser of claim 11 and wherein the user's fingers and thumb are placed within the second medial space defined by the second ring, and the user's fingers are positioned within the plural spacedly arrayed finger extension saddles of the inner circumferentially extending surface of the second ring; and the user's thumb is placed within the thumb extension saddle of the inner circumferentially extending surface of the second ring generally diametrically opposite the plural spacedly arrayed finger extension saddles and along the second minor diameter of the second ring; and repeatedly extending and relaxing the fingers and thumb to responsively distort the original configuration of the second ring generally along the second minor diameter and then allowing the second ring to return to its original configuration and then repeating the extension and distorting.

* * * * *